US005938139A

United States Patent [19]

Lin

[11] Patent Number: 5,938,139

[45] Date of Patent: Aug. 17, 1999

[54] MANUALLY OPERATED SCREEN REELING DEVICE

[76] Inventor: Cheng-Tai Lin, No. 33, Ching-Ho Tsun, Shui-Shang Hsiang, Chia-Yi Hsien, Taiwan

[21] Appl. No.: 08/964,816

[22] Filed: Nov. 5, 1997

[51] Int. Cl.[6] ..... B65H 75/34; E06B 9/56

[52] U.S. Cl. ..... 242/395

[58] Field of Search ..... 242/395; 160/319, 160/320, 321, 322, 307, 308, 297, 298

[56] References Cited

U.S. PATENT DOCUMENTS

| | | | |
|---|---|---|---|
| 4,519,487 | 5/1985 | Florin | 160/319 |
| 5,029,629 | 7/1991 | Cheng-Pei | 160/321 |
| 5,167,269 | 12/1992 | Abo | 160/321 |
| 5,482,105 | 1/1996 | Rude | 160/321 |
| 5,542,464 | 8/1996 | Shiina | 160/321 |
| 5,669,432 | 9/1997 | Nisenson et al. | 160/321 |

*Primary Examiner*—John M. Jillions

*Attorney, Agent, or Firm*—Kane, Dalsimer, Sullivan, Kurucz, Levy, Eisele and Richard, LLP

[57] ABSTRACT

A screen reeling device includes a frame, an axle, a driving member, an elongated roller, and a biasing member. The frame includes left and right bracket members. The axle has a proximate end mounted to the right bracket member, and a distal end. The driving member is retained slidably and rotatably on the frame and has a right transverse end wall proximate to the right bracket member, and a left end portion. The elongated roller is adapted to be wound with the screen thereon, and includes a left end portion journalled on the left bracket member and an axially hollowed right end portion which is sleeved securely on the left end portion of the driving member to be rotatable therewith. The biasing member biases the right transverse end wall axially toward the right bracket member.

4 Claims, 5 Drawing Sheets

MANUALLY OPERATED SCREEN REELING DEVICE

BACKGROUND OF THE INVENTION

1. Field of the Invention

The invention relates to a reeling device, more particularly to a manually operated reeling device for a rolled screen.

2. Description of the Related Art

Referring to FIGS. 1 and 2, a conventional reeling device for a rolled screen 11 is shown to include a frame 21, anaxle31, a positioning member, an elongated roller 12, and a restoration spring member 35.

As illustrated, the frame 21 includes an elongated frame body 21A, and left and right bracket members 22 which are respectively suspended and extend downwardly from left and right ends of the elongated frame body 21A (only one of the bracket members 22 is shown for the sake of clarity). The axle 31 includes two opposed ends 36 respectively fixed in a retainer hole 23 of the left and right bracket members 22. The positioning member includes a positioning disc 32 fixed coaxially on the axle 31 proximate to the left bracket member 22, a rotary plate 34 mounted transversely and rotatably on the axle 31, and a cover member 33 attached on the rotary plate 34. The rotary plate 34 has an engagement tongue 37 mounted pivotally thereon at a position offset relative to a central portion thereof. The elongated roller 12 has an end portion 13 sleeved securely on the rotary plate 34 so as to be co-rotatable therewith. The restoration spring member 35 is mounted around the axle 31 to bias the rotary plate 34 against rotation relative to the axle 31.

When the rolled screen 11 is pulled from the elongated roller 12, the elongated roller 12 drives the rotary plate 34 to rotate about the axle 31 in a predetermined direction such that a distal end 371 of the engagement tongue 37 is forced to slide past an inclined surface 322 of a circumferential groove 321 of the positioning disc 32, thereby unwinding down the rolled screen 11 from the elongated roller 12. When the rolled screen 11 is released, the distal end 371 of the engagement tongue 37 drops into the circumferential groove 321 of the positioning disc 32 to prevent further unreeling of the rolled screen 11.

A drawback of the conventional screen reeling device resides in that the user does not have the option to stopping the rotation of the rotary disc 34 and the elongated roller 12 at the moment a desired length of the rolled screen 11 has been unwound. Since the user is unable to see if the distal end 371 of the engagement tongue 37 has properly and slidably dropped into the circumferential groove 321 of the positioning disc 32, it is possible that the screen 11 will be once again reeled automatically on the elongated roller 12 by virtue of the restoration force of the spring member 35 when pulling force on the screen 11 is released due to inproper engagement between the engagement tongue 37 and the positioning disc 34.

SUMMARY OF THE INVENTION

The object of this invention is to provide a manually operated screen reeling device for a rolled screen which can roll up or roll down the screen without the drawback mentioned beforehand.

Accordingly, the reeling device for a rolled screen of this invention includes a frame, an axle, a manually operated driving member, an elongated roller, means for retaining a slidable and rotatable engagement between the driving member and the frame, and a biasing member. The frame includes an elongated frame body, and left and right bracket members which are suspended from the left and right ends of the elongated frame, respectively. The axle has a proximate end mounted to the right bracket member, and a distal end which extends longitudinally of the elongated frame body toward the left bracket member. The driving member is mounted movably on the axle, and includes a right transverse end wall proximate to the right bracket member, and a left end portion. The elongated roller is adapted to be wound with the screen thereon, and includes a left end portion journalled on the left bracket member, and an axially hollowed right end portion which is sleeved on the left end portion of the driving member so as to be rotatable therewith. The biasing member is mounted on the axle to axially bias the right transverse end wall towards the right bracket member.

BRIEF DESCRIPTION OF THE DRAWINGS

Other features and advantages of this invention will become more apparent in the following detailed description of the preferred embodiments with reference to the accompanying drawings, in which.

DETAILED DESCRIPTION OF THE PREFERRED EMBODIMENTS

Figure 1:
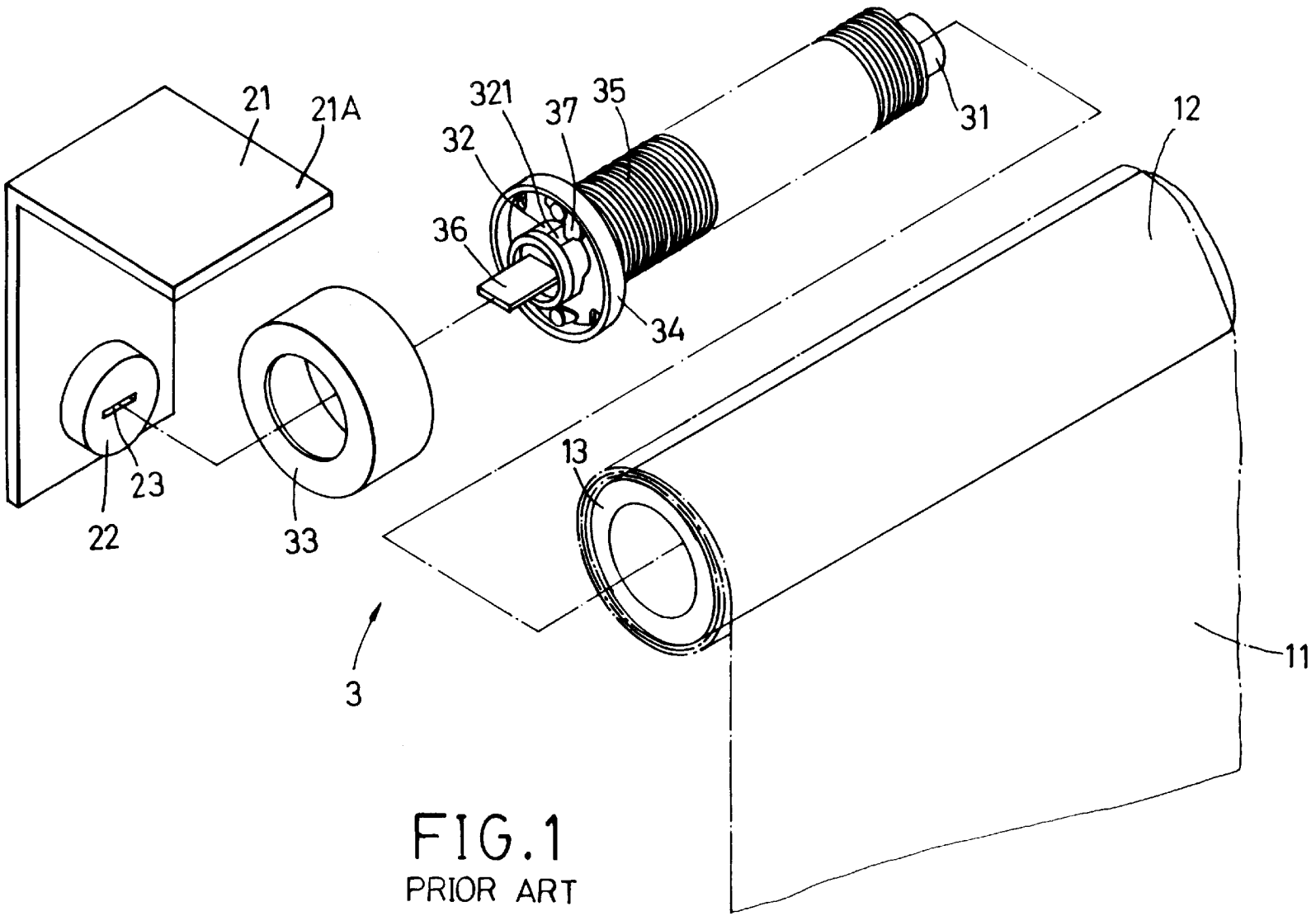
FIG. 1 PRIOR ART
FIG. 1 is an exploded view of a conventional reeling device for a rolled screen.
Figure 2:
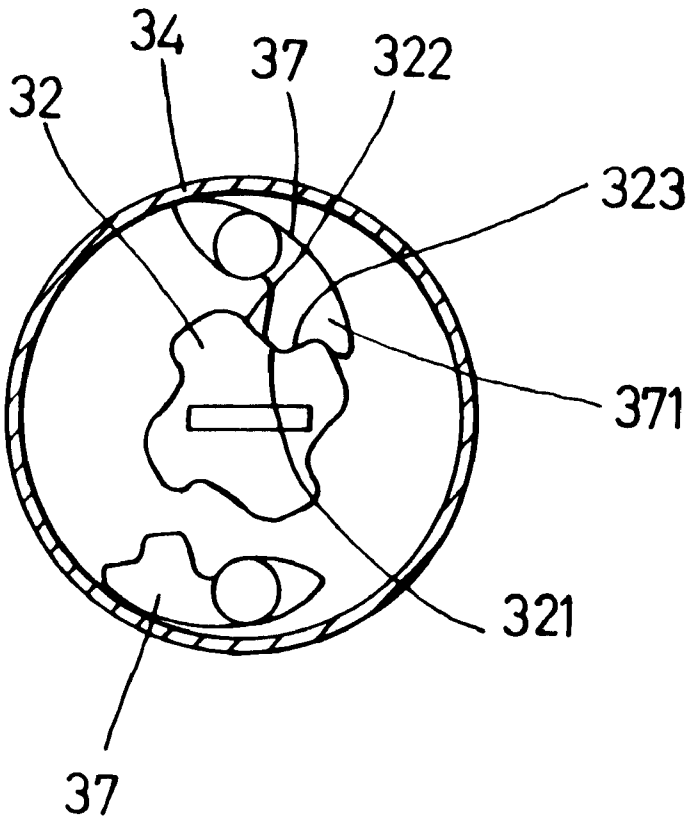
FIG. 2 PRIOR ART
FIG. 2 illustrates how an elongated roller of the conventional screen reeling device is stopped from rotation.
Figure 3:
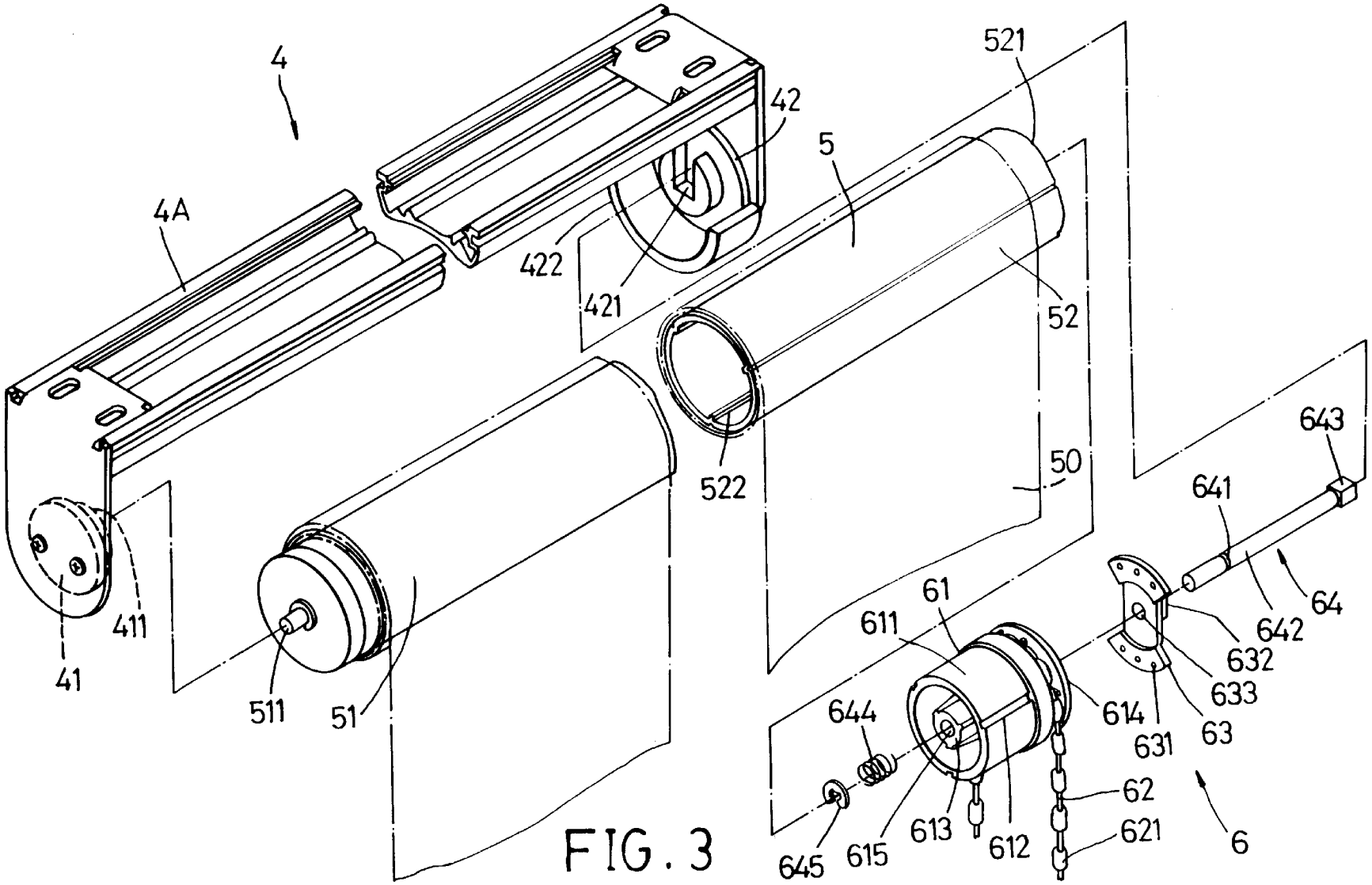
FIG. 3 is an exploded view of the preferred embodiment of a screen reeling device of this invention.
Figure 4:
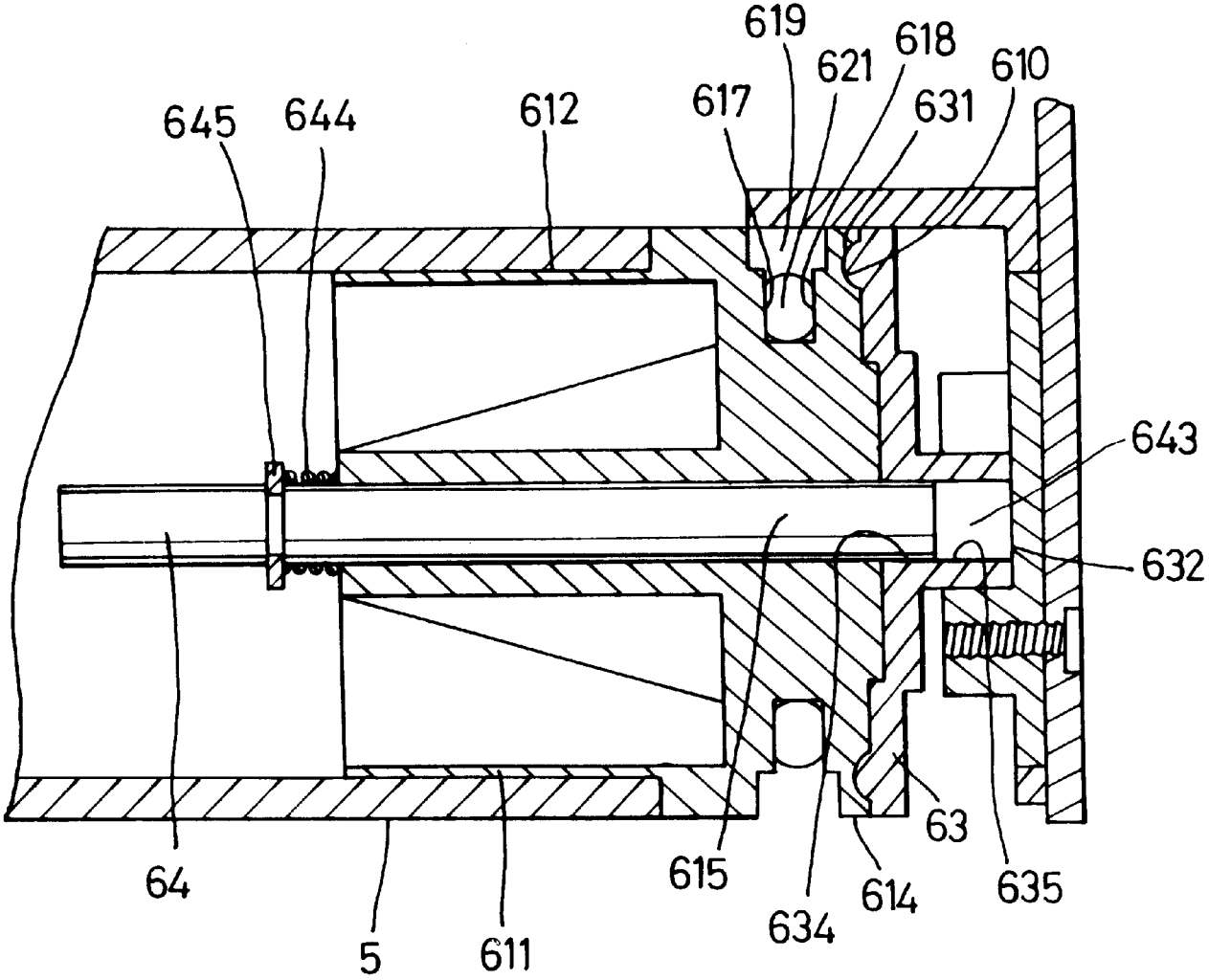
FIG. 4 illustrates a fragmentary sectional view of the preferred embodiment.

Referring to FIGS. 3 and 4, the preferred embodiment of a manually operated screen reeling device for a rolled screen is shown to include a frame 4, an axle 64, a driving member 6, an elongated roller 5, means for retaining a slidable and rotatable engagement between the driving member and the frame 4, and a biasing member 644.

As illustrated, the frame 4 includes an elongated frame body 4A, and left and right bracket members 41, 42 which are respectively suspended and extend downwardly from left and right ends of the elongated frame body 4A.

The axle 64 has a proximate end 643 to be mounted on the right bracket member 42, and a distal end 642 which extends longitudinally relative to the elongated frame body 4A towards the left bracket member 41.

The driving member 6 is mounted on the axle 64 and movable axially thereon. The driving member 6 includes a right transverse end wall 614 proximate to the right bracket member 42, and a left end portion 61.

The elongated roller 5 is adapted to be wound with a screen 50 thereon, and includes a left end portion 51 journalled on the left bracket member 41, and an axially hollowed right end portion 52 which is sleeved on the left end portion 61 of the driving member 6 so as to be rotatable therewith.

The biasing member 644 is mounted on the axle 64 to axially bias the right transverse end wall 614 towards the right bracket member 42.

The retaining means includes an intermediate member 63 mounted transversely on the axle 64 and disposed between the right transverse end wall 614 of the driving member 6 and the right bracket member 42, and a plurality of protrusions 610 and a plurality of matching recesses 631 respectively and circumferentially disposed on two corresponding opposed surfaces of the right transverse end wall 614 and the intermediate member 63.

In the preferred embodiment, the left end portion 61 of the driving member 6 is in the form of a tubular member 611, and includes a hollow mandrel 613 disposed therein and coaxial with the tubular member 611. The mandrel 613 extends from the right transverse end wall 614 towards the left bracket member 41. The mandrel 613 has a left abutment end 615 distal relative to the right transverse end wall 614. The biasing member 644 is a compression spring sleeved on the distal end 642 of the axle 64, and biases the left abutment end 615 to urge the right transverse end wall 614 to abut against the intermediate member 63 such that the protrusions 610 of the intermediary member 63 engage slidably the matching recesses 631. When a manual force is applied on the driving member 6, the protrusions 610 will be slid out of the recesses 631 against the biasing action of the compression spring.

The driving member 6 further includes a chain groove 619 formed on an outer peripheral surface thereof which are defined by two opposed faces 617, 618 of the tubular portion 611 and the right transverse end wall 614, and a pulling chain 62 disposed in the groove 619. The opposed faces 617, 618 are provided with two circles of angularly spaced grooves which cooperatively receive the beads 621 of the chain 62.

The right bracket member 42 has a seat portion formed with a retaining notch 421, and a stop element 422 mounted rotatably on the seat portion such that the stop element 422 can be turned above to cover the notch 421. The left end portion 51 of the elongated roller 5 has a pivot end 511 inserted into a bearing hole 411 of the left bracket member 41.

The intermediate member 63 of the preferred embodiment has a retainer stud 632 retained in the notch 421 of the right bracket member 42, and a stepped through hole 633 aligned with a hole of the mandrel 613. The stepped through hole 633 has an enlarged portion 635 proximate to the right bracket member 42 and a narrow portion 634. When the axle 64 is inserted through the intermediate member 63 and the tubular portion 611, the enlarged proximate end 643 is retained in the enlarged portion 635 while the distal portion 642 projects outwardly from the abutment end 615 of the mandrel 613 and extends towards the left bracket member 41. A C-shaped retainer 645 is disposed in the annular recess 641 of the axle 64 after the compression spring 644 is sleeved over the distal portion 642 so as to prevent axial disengagement between the intermediate member 63 and the left end portion 61.

The driving member 6 further has a plurality of axially extending splines 612, 522 interposed between the hollowed right end portion 52 of the elongated roller 5 and the tubular member 611 in order to prevent relative rotation therebetween. The chain 62 can be pulled in either direction for reeling down or reeling up of the screen 50.

Figure 5:
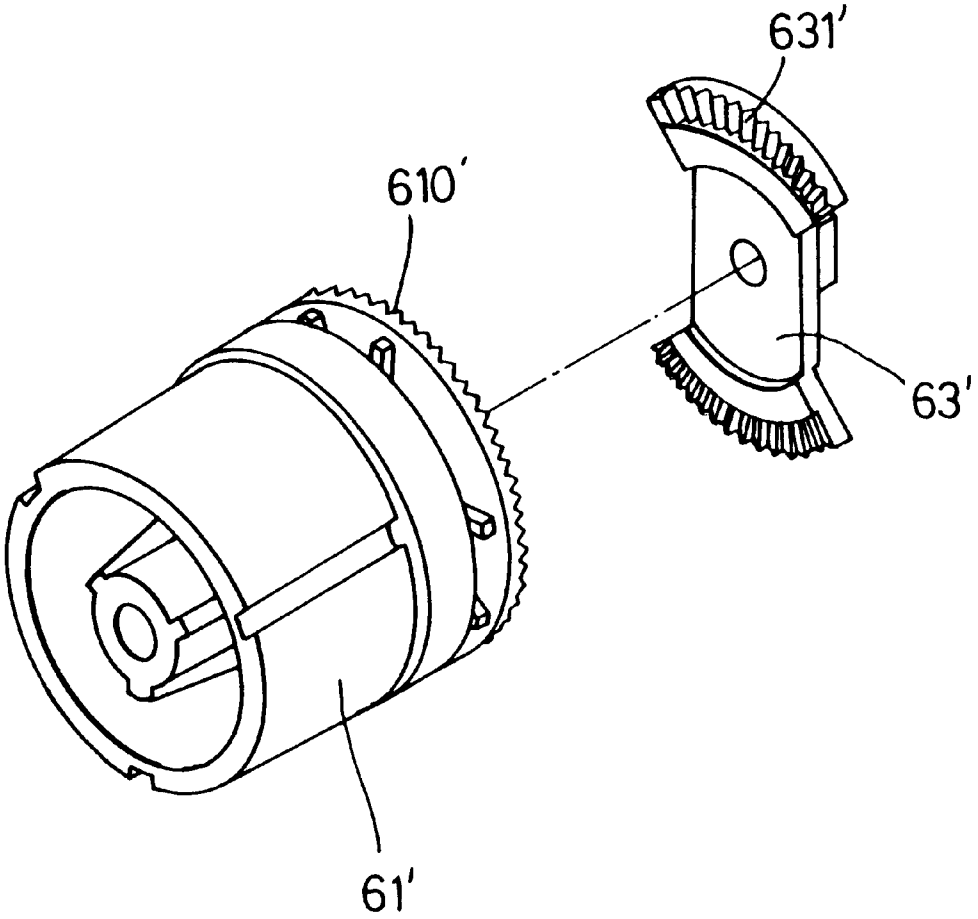
FIG. 5 shows an enlarged view of a modified driving member of the preferred embodiment.

FIG. 5 shows a modified retaining means for retaining a slidable and rotatable engagement between the right transverse end wall of the left end portion 61' of the driving member and the frame (not shown). The right transverse end wall has engagement teeth 610' while the intermediate member 63' has teeth 631' for meshing with the teeth 610'. The features and objects are the same as those of the previous embodiment.

With this invention thus explained, it is apparent that numerous modifications and variations can be made without departing from the scope and spirit of this invention. It is therefore intended that this invention be limited only as indicated in the appended claims.

I claim:

1. A manually operated reeling device for a rolled screen, comprising:

a frame including an elongated frame body, and left and right bracket members respectively suspended and extending downwardly from left and right ends of said elongated frame body;

an axle having a proximate end mounted on said right bracket member, and a distal end which extends longitudinally relative to said elongated frame body towards said left bracket member;

a manually operated driving member mounted on said axle and movable axially thereon, said driving member including a right transverse end wall proximate to said right bracket member, and a left end portion;

an elongated roller adapted to be wound with said rolled screen, and including a left end portion journalled on said left bracket member, and an axially hollowed right end portion which is sleeved on said left end portion of said driving member so as to be rotatable therewith;

means for retaining a slidable and rotatable engagement between said right transverse end wall and said right bracket member;

a biasing member mounted on said axle to axially bias said right transverse end wall towards said right bracket member; and wherein said retaining means includes an intermediate member mounted transversely on said axle and disposed between said right transverse end wall of said driving member and said right bracket member, and a plurality of protrusions and a plurality of matching recesses respectively disposed circumferentially on corresponding opposing surfaces of said right transverse end wall and said intermediate member.

2. The manually operated reeling device as defined in claim 1, wherein said left end portion of said driving member includes a tubular member and a hollow mandrel disposed in and coaxial with said tubular member and extending from said right transverse end wall, said mandrel having a left abutment end distal relative to said right transverse end wall, said biasing member being inboard to and urging against said left abutment end, thereby biasing said right transverse end wall towards said intermediate member, whereby when said driving member is actuated to rotate by an applied force, said plurality of protrusions will be brought out of said matching recesses by said applied force against action of said biasing member.

3. The manually operated reeling device as defined in claim 2, wherein said driving member has a circumferential groove formed between said right transverse end wall and said tubular member and exposed outwardly of said right end portion of said driving member to receive a pulling chain around said circumferential groove such that actuation of said pulling chain drives said driving member.

4. The manually operated reeling device as defined in claim 3, wherein said driving member has an axially extending spline interposed between said hollowed right end portion of said elongated roller and said tubular member in order to prevent relative rotation.

* * * * *